US008939730B2

(12) United States Patent
Wu

(10) Patent No.: US 8,939,730 B2
(45) Date of Patent: Jan. 27, 2015

(54) FAN CONTROL SYSTEM

(75) Inventor: Kang Wu, Shenzhen (CN)

(73) Assignees: Hong Fu Jin Precision Industry (ShenZhen) Co., Ltd., Shenzhen (CN); Hon Hai Precision Industry Co., Ltd., New Taipei (TW)

( * ) Notice: Subject to any disclaimer, the term of this patent is extended or adjusted under 35 U.S.C. 154(b) by 782 days.

(21) Appl. No.: 13/151,370

(22) Filed: Jun. 2, 2011

(65) Prior Publication Data

US 2012/0288375 A1 Nov. 15, 2012

(30) Foreign Application Priority Data

May 13, 2011 (CN) ..... 2011 1 0123428

(51) Int. Cl.
*F04B 41/06* (2006.01)
*F04D 25/16* (2006.01)
*F04D 27/00* (2006.01)

(52) U.S. Cl.
CPC ..... *F04D 27/008* (2013.01); *F04D 25/166* (2013.01)
USPC ..... 417/2

(58) Field of Classification Search
CPC ..... F04D 25/166; F04D 27/008
USPC ..... 417/2
See application file for complete search history.

(56) References Cited

U.S. PATENT DOCUMENTS 7,132,809 B1 * 11/2006 Chang ..... 318/400.13
2007/0110558 A1 * 5/2007 Chen et al. ..... 415/47

FOREIGN PATENT DOCUMENTS

CN 201075819 Y 6/2008

* cited by examiner

*Primary Examiner* — Hal Kaplan
*Assistant Examiner* — Elim Ortiz
(74) *Attorney, Agent, or Firm* — Novak Druce Connolly Bove + Quigg LLP

(57) ABSTRACT

A fan control system includes first and second fan control units. Each fan control unit includes a connector, a delay circuit, a switch unit, and a control circuit. Each connector is connected to a corresponding fan interface to receive a voltage signal. The delay circuit of the first fan control unit delays the voltage signal for a first period of time, and turns on the corresponding switch unit after the first period of time. The delay circuit of the second fan control unit delays the voltage signal for a second period of time, and turns on the corresponding switch unit after the second period of time. Each control circuit receives the corresponding delayed voltage signal, to start the corresponding fan. The first period of time is unequal to the second period of time.

2 Claims, 2 Drawing Sheets

FAN CONTROL SYSTEM

BACKGROUND

1. Technical Field

The present disclosure relates to a fan control system.

2. Description of Related Art

There are many fans in a server system. When the fans rotate at the full speed, there is high energy consumption, so at the instant that the server system is powered on, all of the fans will rotate at the full speed, which leads to the power supplies of the server system being unstable.

BRIEF DESCRIPTION OF THE DRAWINGS

Many aspects of the present embodiments can be better understood with reference to the following drawing. The components in the drawing are not necessarily drawn to scale, the emphasis instead being placed upon clearly illustrating the principles of the present embodiments. Moreover, in the drawing, all the views are schematic, and like reference numerals designate corresponding parts throughout the several views.

DETAILED DESCRIPTION

The disclosure, including the accompanying drawing in which like references indicate similar elements, is illustrated by way of example and not by way of limitation. It should be noted that references to "an" or "one" embodiment in this disclosure are not necessarily to the same embodiment, and such references mean at least one.

Figure 1:
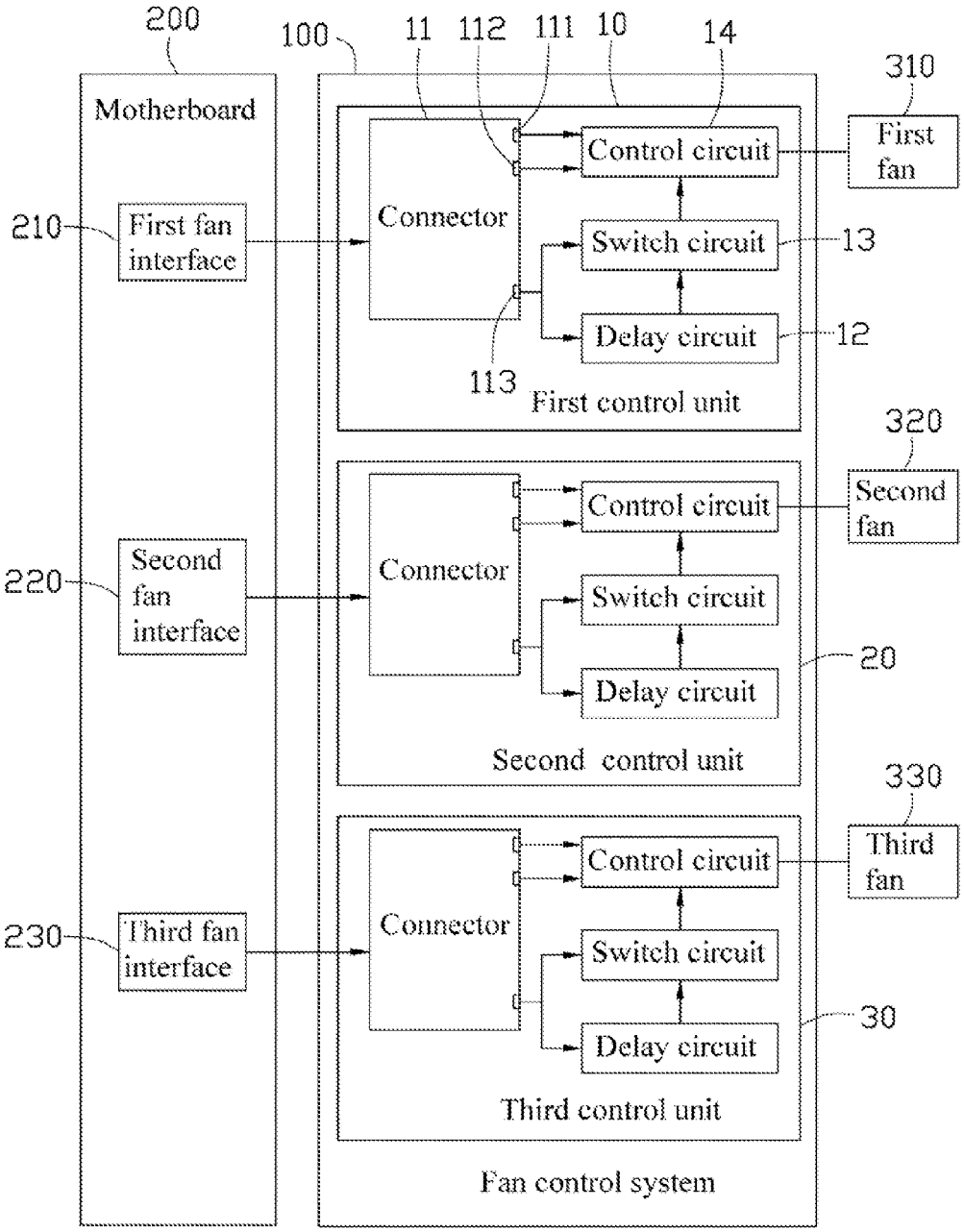
FIG. 1 is a block diagram of an embodiment of a fan control system connected between interfaces of a motherboard and fans, the fan control system includes a control unit.

Referring to the FIG. 1, an embodiment of a fan control system 100 is connected between first to third fan interfaces 210-230 of a motherboard 200 and first to third fans 310-330, to control the first to third fans 310-330 to start at different time. The fan control system 100 includes first to third control unit 10-30. The first control unit 10 is connected between the first fan interface 210 and the first fan 310. The second control unit 20 is connected between the second fan interface 220 and the second fan 320. The third control unit 30 is connected between the third fan interface 230 and the third control circuit 330. The first to third control units 10-30 have the same circuit structure and function. The first control unit 10 is taken as an example to be described as follow.

The first control unit 10 includes a connector 11, a delay circuit 12, a switch circuit 13, and a control circuit 14. The connector 11 is connected to the first fan interface 210 to receive a voltage signal, a control signal, and a detection signal from the motherboard 200. The connector 11 includes a control pin 111, a detection pin 112, and a power pin 113. The control pin 111 and the detection pin 112 are both connected to the control circuit 14 to output the control signal and the detection signal to the control circuit 14. The power pin 113 is also connected to the control circuit 14 through the switch circuit 13. The delay circuit 12 is connected between the power pin 113 of the connector 11 and the switch unit 13, to delay the voltage signal from the power pin 113 for a first period of time T1, and output a turning on signal to turn on the switch unit 13 after the first period of time T1. The control circuit 14 is connected to the first fan 310 to start the first fan 310 when the voltage signal is supplied to the control circuit 14.

Figure 2:
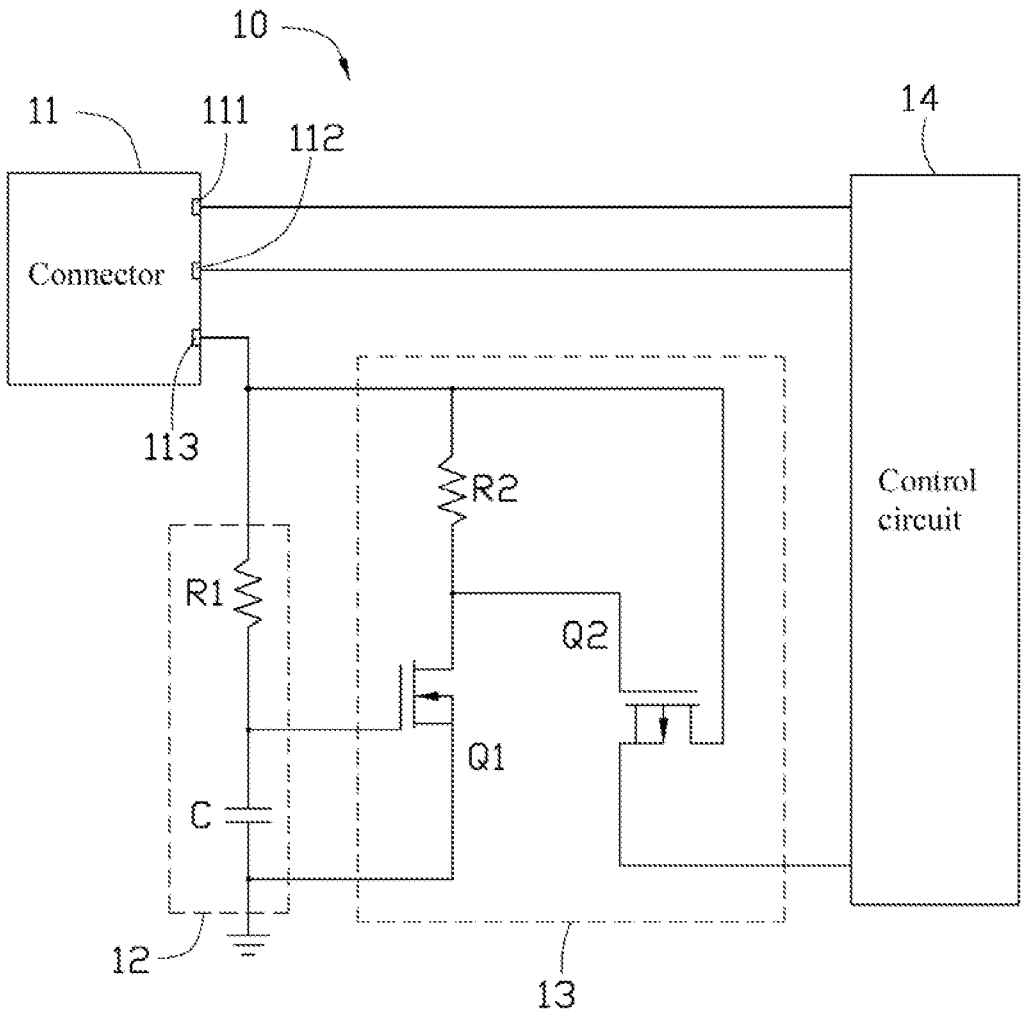
FIG. 2 is a circuit diagram of the control unit of FIG. 1.

Referring to FIG. 2, the delay circuit 12 includes a resistor R1 and a capacitor C. The switch circuit 13 includes a resistor R2, a first transistor Q1, and a second transistor Q2. The resistor R1 and the capacitor C are connected in series between the power pin 113 of the connector 11 and ground. A gate of the first transistor Q1 is connected to a node between the resistor R1 and the capacitor C. A source of the first transistor Q1 is grounded. A drain of the first transistor Q1 is connected to the power pin 113 of the connector 11 through the resistor R2. A gate of the second transistor Q2 is connected to the drain of the first transistor Q1. A source of the second transistor Q2 is connected to the control circuit 14. A drain of the second transistor Q2 is connected to the power pin 113 of the connector 11. The first transistor Q1 is an n-type field effect transistor (FET). The second transistor Q2 is a p-type FET.

When the motherboard 200 is powered on, the fan interface 210 outputs the voltage signal to the power pin 113 of the connector 11 to charge the capacitor C. A voltage at the node between the resistor R1 and the capacitor C is greater than the turning on voltage of the first transistor Q1 after the first period of time T1. The first transistor Q1 is turned on. The second transistor Q2 is turned on. The voltage signal from the power pin 113 of the connector 11 is output to the control circuit 14 through the second transistor Q2. The control circuit 14 starts the first fan 310 when the control circuit 14 receives the voltage signal, that is, the first fan 310 is started after the first period of time T1. The first period of time T1 increases when the product of a resistance of the resistor R1 and a capacitance of the capacitor C increases. The first period of time T1 decreases when the product of a resistance of the resistor R1 and the capacitance of the capacitor C decrease.

Similarly, the second fan 320 is started after a second period of time T2. The third fan 330 is started after a third period of time T3. The first to third periods of time T1-T3 are made different by selecting different resistors and capacitors of the delay circuits of the first to third control units 10-30. Therefore, the first to third fan 310-330 will be started at different time.

It is to be understood, however, that even though numerous characteristics and advantages of the embodiments have been set forth in the foregoing description, together with details of the structure and function of the embodiments, the disclosure is illustrative only, and changes may be made in details, especially in matters of shape, size, and arrangement of parts within the principles of the embodiments to the full extent indicated by the broad general meaning of the terms in which the appended claims are expressed.

What is claimed is:

1. A fan control system to control first and second fans to be started at different time, the fan control system comprising:

a first fan control unit connected between a first fan interface of a motherboard and the first fan; and a second fan control unit connected between a second fan interface of the motherboard and the second fan, wherein each of the first and second fan control units comprising:

a connector connected to the corresponding fan interface of the motherboard to receive a voltage signal, and comprising a power pin;

a delay circuit connected to the power pin of the connector, to delay the voltage signal from the connector for a period of time, and output a turning on signal after the period of time, wherein the delay circuit comprises a first resistor and a capacitor, the first resistor and the capacitor are connected in series between the power pin of the connector and ground;

a switch unit connected to the delay circuit to be turned on after receiving the turning on signal, and connected to the power pin of the connector to transmit the voltage signal to the corresponding fan after being turned on, wherein the switch circuit comprises a second resistor, a first transistor, and a second transistor, a gate of the first transistor is connected to a node of the first resistor and the capacitor, a source of the first transistor is grounded, a drain of the first transistor is connected to the power pin of the connector through the second resistor, a gate of the second transistor is connected to the drain of the first transistor, and a drain of the first transistor is connected to the power pin of the connector; and a control circuit connected between the switch unit and the corresponding fan to receive the delayed voltage signal, and to start the corresponding fan after receiving the delayed voltage signal, a source of the second transistor is connected to the control circuit;

wherein the delay circuit of the first fan control unit delays the voltage signal for a first period of time, the delay circuit of the second fan control unit delays the voltage signal for a second period of time, and the first period of time is unequal to the second period of time.

2. The fan control system of claim 1, wherein the first transistor is an n-type filed effect transistor (FET), and the second transistor is a p-type FET.

* * * * *